US006070921A

United States Patent [19]

Valasin

[11] Patent Number: 6,070,921

[45] Date of Patent: Jun. 6, 2000

[54] LIFT-GATE DUAL LATCH WITH AUXILIARY SPRING

[75] Inventor: Anthony Jerome Valasin, Grosse Ile, Mich.

[73] Assignee: Ford Global Technologies, Inc., Dearborn, Mich.

[21] Appl. No.: 09/292,415

[22] Filed: Apr. 15, 1999

[51] Int. Cl.[7] ..... E05C 3/06

[52] U.S. Cl. ..... 292/216; 292/DIG. 43; 292/DIG. 61

[58] Field of Search ..... 292/216, DIG. 29, 292/DIG. 42, DIG. 43, DIG. 61, DIG. 72, DIG. 23

[56] References Cited

U.S. PATENT DOCUMENTS

| | | | |
|---|---|---|---|
| 4,896,907 | 1/1990 | Hayakawa et al. | 292/216 |
| 4,906,035 | 3/1990 | Nagai et al. | 292/201 |
| 4,961,601 | 10/1990 | Lindholm et al. | 292/216 |
| 4,974,885 | 12/1990 | Yokoyama | 292/201 |
| 5,048,877 | 9/1991 | Rogers, Jr. et al. | 292/110 |
| 5,118,146 | 6/1992 | Watanuki | 292/216 |
| 5,222,775 | 6/1993 | Kato | 292/201 |
| 5,295,720 | 3/1994 | Budde | 292/201 |
| 5,348,355 | 9/1994 | Oyha | 292/11 |
| 5,632,515 | 5/1997 | Dowling | 292/216 |
| 5,853,060 | 12/1998 | Chao et al. | 180/69.2 |
| 5,868,444 | 2/1999 | Brackmann et al. | 292/201 |
| 5,941,579 | 8/1999 | Baniak | 292/216 |

*Primary Examiner*—Suzanne Dino Barrett
*Assistant Examiner*—Clifford B Vaterlaus
*Attorney, Agent, or Firm*—Joseph W. Malleck

[57] ABSTRACT

A lift-gate dual latch mechanism utilizing both a primary spring and an auxiliary spring operates to provide the additional force needed to release a striker member from both stop positions of a dual latch. Without the auxiliary spring as mentioned above, the lift-gate, being a heavy member typically stays in the latching mechanism when the lift-gate key is actuated to the open position. This requires additional lift forces, such as added springs between the lift-gate and the back panel of the vehicle to open the lift-gate from the mandated second lock position. Gas cylinders are shown to assist the opening of the lift-gate when required.

5 Claims, 4 Drawing Sheets

LIFT-GATE DUAL LATCH WITH AUXILIARY SPRING

BACKGROUND OF THE INVENTION

1. Field of the Invention

This invention relates to latch mechanisms in general and more particularly to dual latch mechanisms as may be found latching the tail-gate or lift-gate of a motor vehicle.

2. Description of the Related Art

Present vehicles have either a single or dual latching mechanism to secure the lift-gate to the vehicle in the locked position. When the vehicle operator wants to open the lift-gate, the mechanism is actuated and the rotor rotates to move the striker free of the latch. On lift-gates that are heavy because of their size and construction, the weight of the lift-gate is such that the striker does not leave the rotor. The vehicle operator then has to lift the lift-gate by hand.

Some improvements to the prior art are the adaptation of compression springs to the lift-gate that are compressed when the lift-gate is locked. Once the rotor rotates to unleash the striker, the springs add a lifting force to help operate the striker move from the latch rotor that allows the lift-gate to rotate to its open position. Such improvements, when spread across many vehicles, are expensive and labor intensive to add to a vehicle.

SUMMARY OF THE INVENTION

It is a principle advantage of the present lift-gate dual latch to provide a means causing the lift-gate to leave the secondary latch when the rotor is rotated thereby having the lift-gate fully unlatched.

It is another advantage to reduce the cost of the lift-gate dual latch system by incorporating an additional force element into the latch mechanism.

It is yet another advantage to remove any augmented operation force members such as compression springs that are connected to the lift-gate and bear against the back panel of the vehicle.

These and other advantages will become obvious from the following drawings, detailed description and claims of a lift-gate dual latch mechanism for use on motor vehicles with a lift-gate pivotally mounted at the rear of a motor vehicle. The lift-gate is normally in an unlocked position for gaining access into the motor vehicle, being held there by means such as gas cylinders. A striker member is mounted to the lift-gate at the end of the lift-gate opposite its pivotally mounted end. The striker member is operable to secure the lift-gate against the back panel of the vehicle in a locked position.

A back panel member mounted on the motor vehicle has a dual latch mechanism mounted thereon. The latch mechanism is operable to receive and secure the striker member for holding the lift-gate in a locked position. A rotor member is rotatively mounted in the latch mechanism and has an open ended slot for holding the striker member when the lift-gate is in a locked position. A lock pawl is pivotally mounted in the dual latch mechanism and is operable to hold the rotor member in either a first or second locked position for maintaining the lift-gate in an unopened position.

A primary spring is operatively connected between the rotor member and the lock pawl for rotating the rotor member in the same direction as the lock pawl when it is actuated by a key means to disengage the rotor member.

A link member having a hole at one end for pivotally mounting the link to the rotor member and a slotted hole at the other end for mounting the link member to the latch mechanism frame member. The link is operable to follow the rotation of the rotor member.

An auxiliary spring is connected at one end to the link and at its other end to the latch mechanism frame member providing an additional biasing force on the rotor member to rotate the rotor in a direction to disengage the rotor. The lock pawl releases the striker member from the open-ended slot in the rotor member, whereby the lift-gate pivots to its opened position from the first and second locked position.

DETAILED DESCRIPTION OF THE PREFERRED EMBODIMENT

Figure 1:
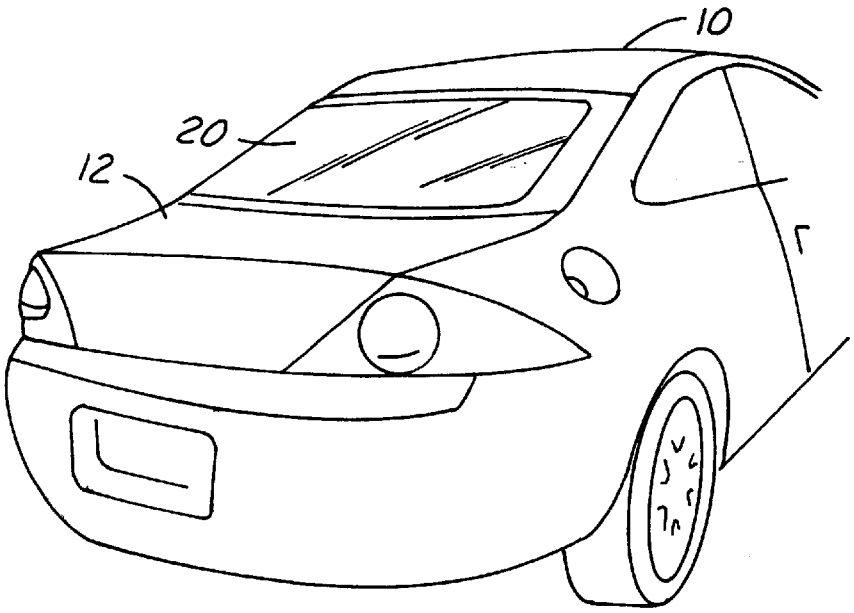
FIG. 1 is a perspective view from the rear of a motor vehicle with the lift-gate closed.
Figure 2:
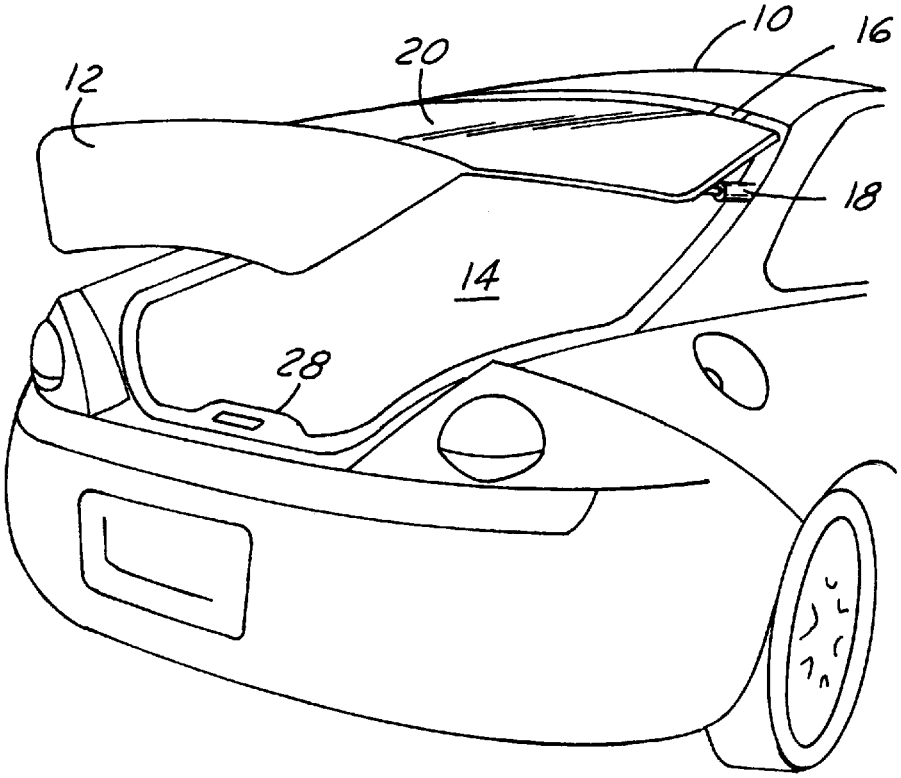
FIG. 2 is a perspective view from the rear of a motor vehicle with the lift-gate open.
Figure 4:
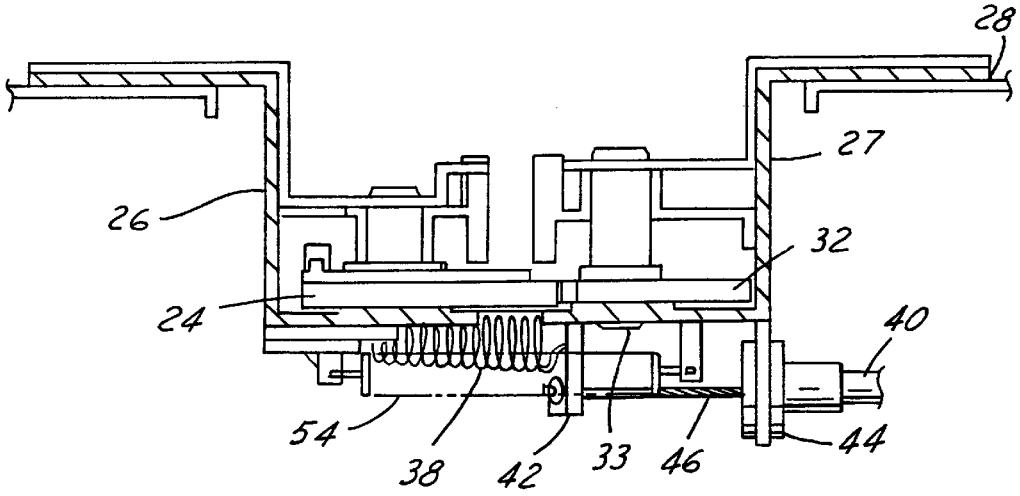
FIG. 4 is a plan view of FIG. 3 taken in direction of line 4—4 in FIG. 3.

Referring to the FIGS. by the characters of reference, there is illustrated in FIGS. 1 and 2 a rear perspective view of a motor vehicle 10 with a lift-gate 12. The difference between FIG. 1 and FIG. 2, is that the lift-gate 12 in FIG. 2 is opened exposing the inside 14 of the vehicle 10. The lift-gate 12 is pivotally mounted by hinge means 16 at the rear near the roof of the vehicle 10 and normally in an unlocked position for gaining access into the motor vehicle 10 as shown in FIG. 2. To secure the lift-gate 12 in an open position, there is means such as a pair of gas-cylinders 18, one shown, is typically mounted to the vehicle 10 and to the lift-gate.

Figure 3:
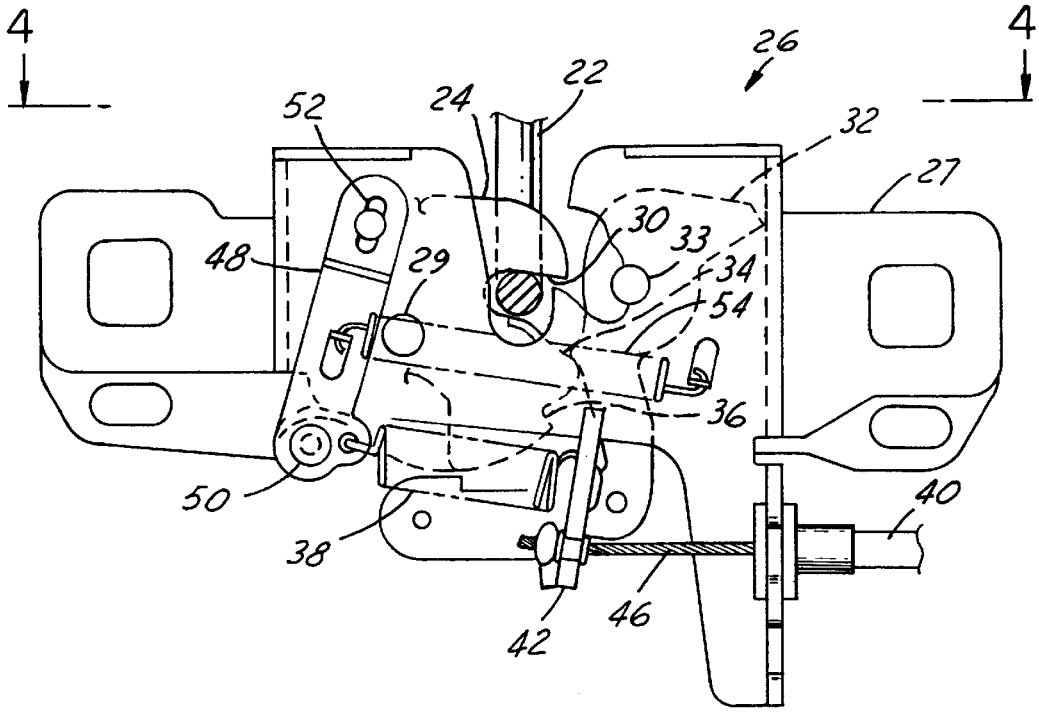
FIG. 3 is a front view of the dual latch in its fully locked position.

The lift-gate 12 typically has a huge expanse of glass comprising the rear window 20. The window is very heavy and this is weight that makes the lift-gate 12 a burden to open for a normal dual latch mechanism requiring the need for augmented lift-off springs between the lift-gate and the vehicle back panel. The lift-gate 12 is typically mounted by a hinge means 16 to the vehicle 10. Mounted to the lift-gate at the end of the lift-gate opposite its pivotally-mounted end 16, is a striker member 22 that is operable to secure the lift-gate 12 in a locked position. The striker member 22 is shown in FIG. 3. The striker member is typically a u-shaped member with a rounded cross-section that cooperates with a rotor member 24 to secure the lift-gate 12 in a locked position. The rotor member 24 is secured in a dual latch mechanism 26 that is mounted by means of a bracket 27 to a back panel member 28 that is mounted on the motor vehicle 10. The latch mechanism 26 is operable to receive and secure the striker member 22 for holding the lift-gate 12 in a locked position.

Figure 5:
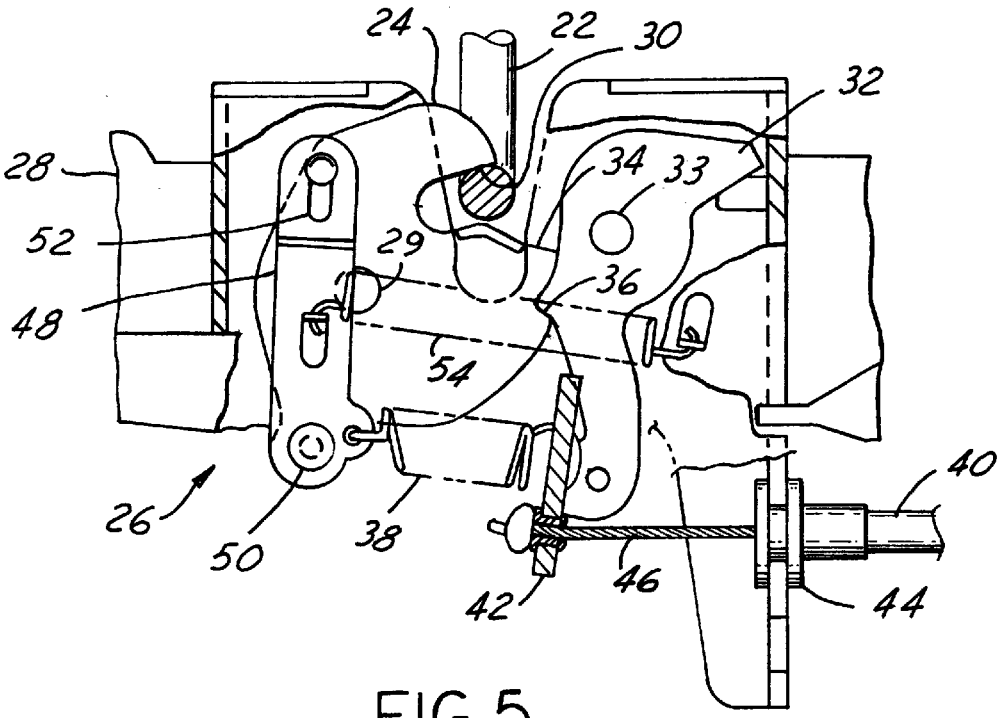
FIG. 5 is another front view similar to FIG. 3 of the dual latch in its secondary locked position.
Figure 6:
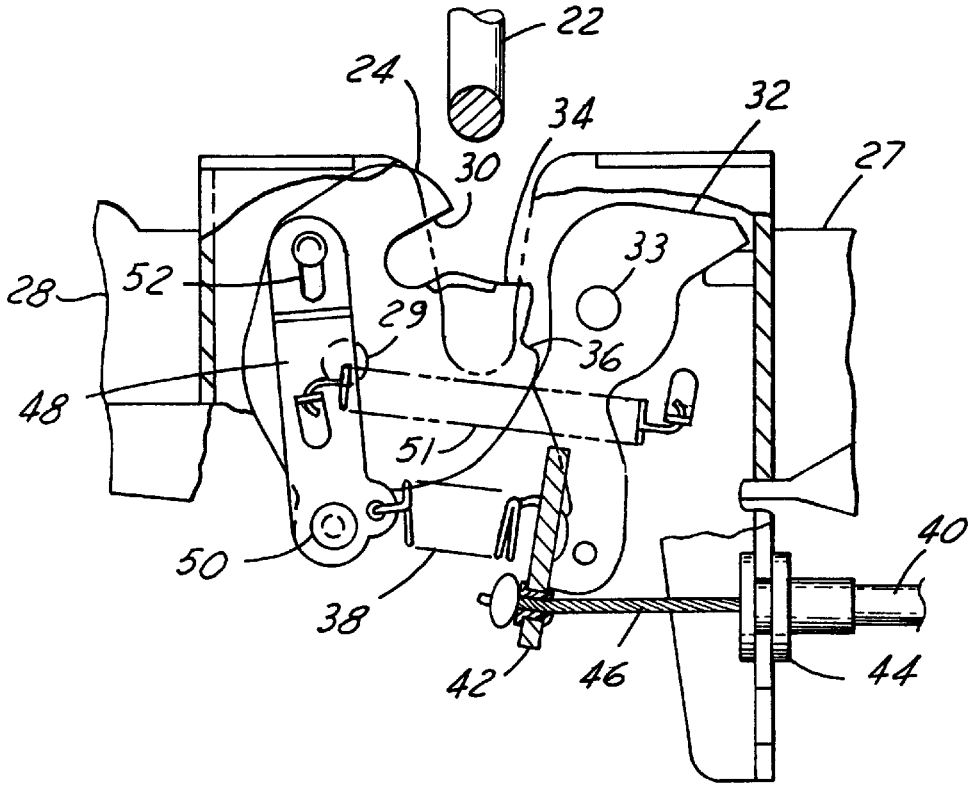
FIG. 6 is another front view with the dual latch in its fully opened position.
Figure 7:
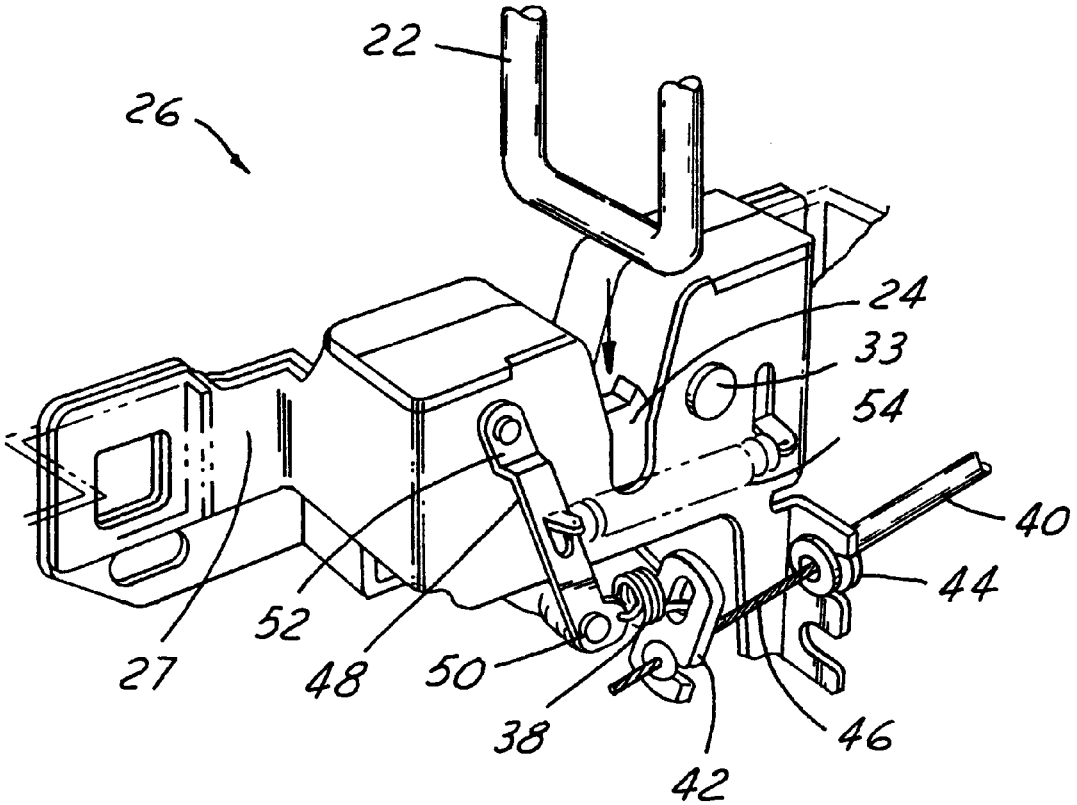
FIG. 7 is perspective view of the dual lock mechanism fully opened.

As illustrated in FIG. 3, the rotor member 24 is rotatively mounted about pivot 29 in the latch mechanism 26 and has open ended slot 30 for holding the striker member 22 when the lift-gate 12 is in a locked position. A lock pawl 32 is pivotally mounted about a pivot 33 in the latch mechanism 26 and operates to hold the rotor member 24 in either a first 34 or second 36 locked position to maintain the lift-gate 12 in an unopened position. FIG. 3 illustrates the rotor member in a first locked position 34 and FIG. 5 illustrates the rotor member 24 in a second locked position 36. This is the dual latch feature of the latch mechanism 26.

A primary spring 38 is operatively connected between the rotor member 24 and the lock pawl 32 for rotating the rotor member in the same direction as the lock pawl when the lock pawl is actuated to disengage the rotor member 24 to open the lift-gate 12. Typically a bowden cable 40 that is connected to the lock pawl at one end and to the key lock cylinder, not shown, at the other end of the cable 40 actuates the lock pawl 32. As illustrated in the FIGS. the bowden cable 40 is secured by a plastic bushing in an aperture opening 42 in the lock pawl and the outside sheath of the bowden cable 40 is secured in a bushing means 44 in the bracket 27. As the cable means 46 of the bowden cable 40 is pulled to the right in the FIGS., the lock pawl 32 is pivoted in an counterclockwise direction and the rotor member 24 is released to also pivot in a counterclockwise direction releasing the striker member 22. Due to the weight of the glass 20 and the lift-gate 12 as previously indicated, the lift-gate 12 does not pivot enough to fully open by itself.

A link member 48 has a hole 50 at one end for pivotally mounting the link to the rotor member 24 and a slotted hole 52 at the other end for mounting the link to the frame of the latch mechanism 26. The link member 48 operates to follow the rotation of the rotor member 24. An auxiliary spring 54 is connected at one end to the link member 48 and at its other end to the frame of the latch mechanism 26. The auxiliary spring 54 provides an additional biasing force on the rotor member 24 to rotate the rotor member in a counterclockwise direction to disengage the lock pawl 32 from the rotor member 24. When the rotor member fully rotates in a counterclockwise direction, the striker member 22 is released from the open ended slot 30 in the rotor member. When this happens, the lift-gate 12 pivots to its opened position from the first 34 and second 36 locked positions.

Both the primary spring 38 and the auxiliary spring 54 are effectively connected in parallel to provide a biasing force to rotate the rotor member 24 in a counterclockwise direction for releasing the striker member 22. When the lift-gate 12 is closed, the striker member 22 causes the rotor member 24 to rotate from its fully open position to the fully locked position stretching both the primary 38 and auxiliary 50 springs to increase their biasing force when the lift-gate is opened. This increased biasing force functions to cause the lift-gate 12 to pivot about its pivots 16 and allows the gas cylinders 18 to assist in opening the lift-gate.

There has thus been illustrated and described a lift-gate dual latch mechanism for use on motor vehicles to increase the opening forces of a heavy lift-gate. The principle of the preferred embodiment of the link member and auxiliary spring and the various members connected thereto can be applied in other instances. While a lift-gate on a motor vehicle is illustrated, such a lift-gate may be a tail-gate; a cover for a container; etc. to name but a few uses where an additional force is required beyond the unlocking force to lift the cover open.

What is claimed is:

1. A lift-gate dual latch mechanism for use on motor vehicles comprising:

a lift-gate adapted to be mounted at the rear of a motor vehicle and normally in an unlocked position for gaining access into the motor vehicle;

a striker member mounted to said lift-gate at the end of said lift-gate opposite its pivotally mounted end, said striker member operable to secure said lift-gate in a locked position;

a back panel member adapted to be mounted on the motor vehicle;

a latch mechanism mounted on said back panel member and operable to receive and secure said striker member for holding said lift-gate in a locked position;

a rotor member rotatively mounted in said latch mechanism and having open ended slot for holding said striker member when said lift-gate is in a locked position;

a lock pawl pivotally mounted in said latch mechanism and operable to hold said rotor member in either a first or second locked position for maintaining said lift-gate in an unopened position;

a primary spring operatively connected between said rotor member and said lock pawl for rotating said rotor member in the same direction as said lock pawl is actuated to disengage said rotor member;

a link member having a hole at one end for pivotally mounting said link to said rotor member and a slotted hole at the other end for mounting said link to said latch mechanism, said link operable to follow the rotation of said rotor member; and an auxiliary spring connected at one end to said link and at its other end to said latch mechanism providing an additional biasing force on said rotor member to rotate said rotor in a direction to disengage said lock pawl from said rotor to release said striker member from said open ended slot in said rotor member;

whereby the lift-gate pivots to its opened position from said first and second locked position.

2. A lift-gate dual latch mechanism according to claim 1 additionally including a bowden cable operatively connected for rotating said lock pawl to release said rotor and said striker.

3. A lift-gate dual latch mechanism according to claim 1 wherein said primary spring and said auxiliary spring are operatively connected in parallel providing biasing force to rotate said rotor member in a direction to release said striker member.

4. A lift-gate dual latch mechanism according to claim 1 additionally including an upright tab located intermediate said hole and said slotted hole on said link for securing said auxiliary spring to said link and biasing said rotor to an unlocked position.

5. A lift-gate dual latch mechanism according to claim 1 wherein said striker is a u-shaped member with rounded cross-section operable to engage said open ended slot on said rotor causing said rotor to rotate from said open position to said fully locked position stretching said primary and auxiliary springs increasing said bias force.

* * * * *